US008770212B2

(12) United States Patent
Alghazi

(10) Patent No.: US 8,770,212 B2
(45) Date of Patent: Jul. 8, 2014

(54) METHOD OF OPERATION OF A PORTABLE MULTIFUNCTIONAL MOBILITY AID APPARATUS

(76) Inventor: Ahmad AlSayed M. Alghazi, Santa Clara, CA (US)

( * ) Notice: Subject to any disclaimer, the term of this patent is extended or adjusted under 35 U.S.C. 154(b) by 0 days.

(21) Appl. No.: 13/527,417

(22) Filed: Jun. 19, 2012

(65) Prior Publication Data

US 2012/0318587 A1 Dec. 20, 2012

Related U.S. Application Data

(60) Provisional application No. 61/520,952, filed on Jun. 20, 2011.

(51) Int. Cl.
*A61H 3/04* (2006.01)

(52) U.S. Cl.
USPC ..... 135/66

(58) Field of Classification Search
USPC ..... 135/66, 69, 75; 5/86.1, 87.1
See application file for complete search history.

(56) References Cited

U.S. PATENT DOCUMENTS

| | | | | | |
|---|---|---|---|---|---|
| 3,154,290 | A * | 10/1964 | Johnson | 254/8 C |
| 3,189,345 | A * | 6/1965 | Simpson | 482/67 |
| 3,397,883 | A | 8/1968 | Kiehn | |
| 4,443,902 | A * | 4/1984 | Baer | 5/87.1 |
| 4,704,749 | A * | 11/1987 | Aubert | 5/87.1 |
| 5,265,689 | A * | 11/1993 | Kauffmann | 180/65.51 |
| 5,411,044 | A | 5/1995 | Andolfi | |
| 5,428,851 | A * | 7/1995 | Shore et al. | 5/87.1 |
| 6,092,247 | A | 7/2000 | Wilson | |
| 6,430,761 | B1 * | 8/2002 | Brandorff et al. | 5/86.1 |
| 6,733,018 | B2 * | 5/2004 | Razon | 280/87.021 |
| 7,506,388 | B1 * | 3/2009 | Brown | 5/86.1 |
| 8,468,622 | B2 * | 6/2013 | Purwar et al. | 5/86.1 |
| 2006/0137091 | A1 * | 6/2006 | Gramkow et al. | 5/86.1 |
| 2008/0072940 | A1 * | 3/2008 | Cheng et al. | 135/66 |
| 2013/0117929 | A1 * | 5/2013 | Palay et al. | 5/87.1 |

FOREIGN PATENT DOCUMENTS

WO WO 01/21128 A1 3/2001

OTHER PUBLICATIONS

U.S. Appl. No. 13/527,379, filed Jun. 19, 2012, Alghazi.
U.S. Appl. No. 29/406,236, filed Nov. 10, 2011, Alghazi.

* cited by examiner

*Primary Examiner* — Noah Chandler Hawk
(74) *Attorney, Agent, or Firm* — Oblon, Spivak, McClelland, Maier & Neustadt, L.L.P.

(57) ABSTRACT

A method of operating a portable, foldable, and multifunctional mobility aid apparatus that assists a user in standing, sitting, and/or walking process. The apparatus has an integrated power source and is based on 4 wheels. Users can stand on it and drive it as an electric mobility device, or disable it and use it as a passive walker. The apparatus has a pair of supporting beams with adjustable width to be placed under the user armpits and support the user in standing up, sitting down, and/or moving around. The apparatus can be controlled by a control panel mounted on a pair of handles, and its functions can be controlled by the user with no need for help from another person. The apparatus can be minimized by a combination of multiple telescopic vertical minimization mechanisms and multiple folding mechanisms.

2 Claims, 19 Drawing Sheets

| | Right Front Wheel | Left Front Wheel |
|---|---|---|
| Forward | Clockwise | Counter Clockwise |
| Backward | Counter Clockwise | Clockwise |
| Turn Right | Counter Clockwise | Counter Clockwise |
| Turn Left | Clockwise | Clockwise |

*Fig. 20*

METHOD OF OPERATION OF A PORTABLE MULTIFUNCTIONAL MOBILITY AID APPARATUS

CROSS REFERENCE TO RELATED APPLICATIONS

The present application claims the benefit of the earlier filing date of U.S. Provisional Application 61/520,952 filed Jun. 20, 2011, the contents of which being incorporated herein by reference in its entirety. The present application also contains subject matter related to that described in co-pending, commonly owned U.S. patent application Ser. No. 13/527,379, having a common filing date as the present application.

GRANT OF NON-EXCLUSIVE RIGHT

This application was prepared with financial support from the Saudi Arabian Cultural Mission, and in consideration therefore the present inventor has granted The Kingdom of Saudi Arabia a non-exclusive right to practice the present invention.

BACKGROUND

1. Field of the Disclosure

This disclosure relates to a method of operation of a mobility aid device, and more specifically, to a method of operation of a portable, foldable, and multifunctional mobility aid device that assists the user in standing up, sitting down, and/or walking.

2. Description of the Related Art

The "background" description provided herein is for the purpose of generally presenting the context of the disclosure. Work of the presently named inventor, to the extent it is described in this background section, as well as aspects of the description which may not otherwise qualify as prior art at the time of filing, are neither expressly nor impliedly admitted as prior art against the present invention.

Existing mobility aid devices generally fail in providing independent mobility aid to a user, as they require help and supervision of another person. Also, many such devices are not foldable and portable.

SUMMARY

This disclosure describes a portable, foldable, and multifunctional mobility aid device that assists the user in standing up, sitting down, and/or walking. Users can stand on the device and drive it as an electric mobility device. The device may also be used as a conventional passive walker. The device has an integrated power source and, in one non-limiting embodiment, is based on 4 wheels. The device includes a pair of supporting beams to be placed under the user's armpits. The distance between the pair of supporting beams is adjustable to properly fit the user. Device functions are controlled via a control panel located on a pair of user handles.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 20 is a table showing the operation of the front wheels in response to user commands.

DETAILED DESCRIPTION OF THE EMBODIMENTS

Figure 1:
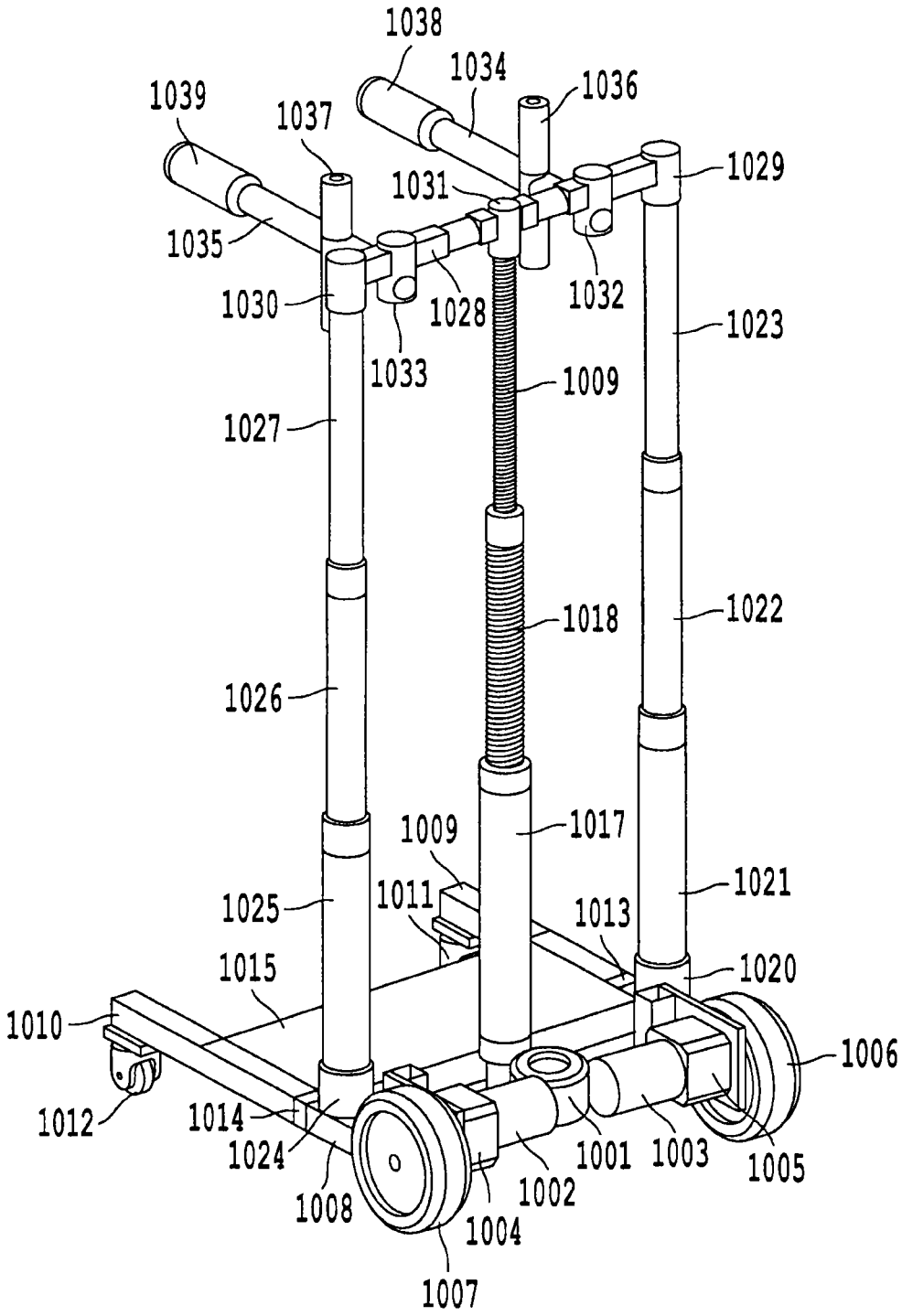
FIG. 1 is a perspective device view when the device is fully opened.
Figure 2:
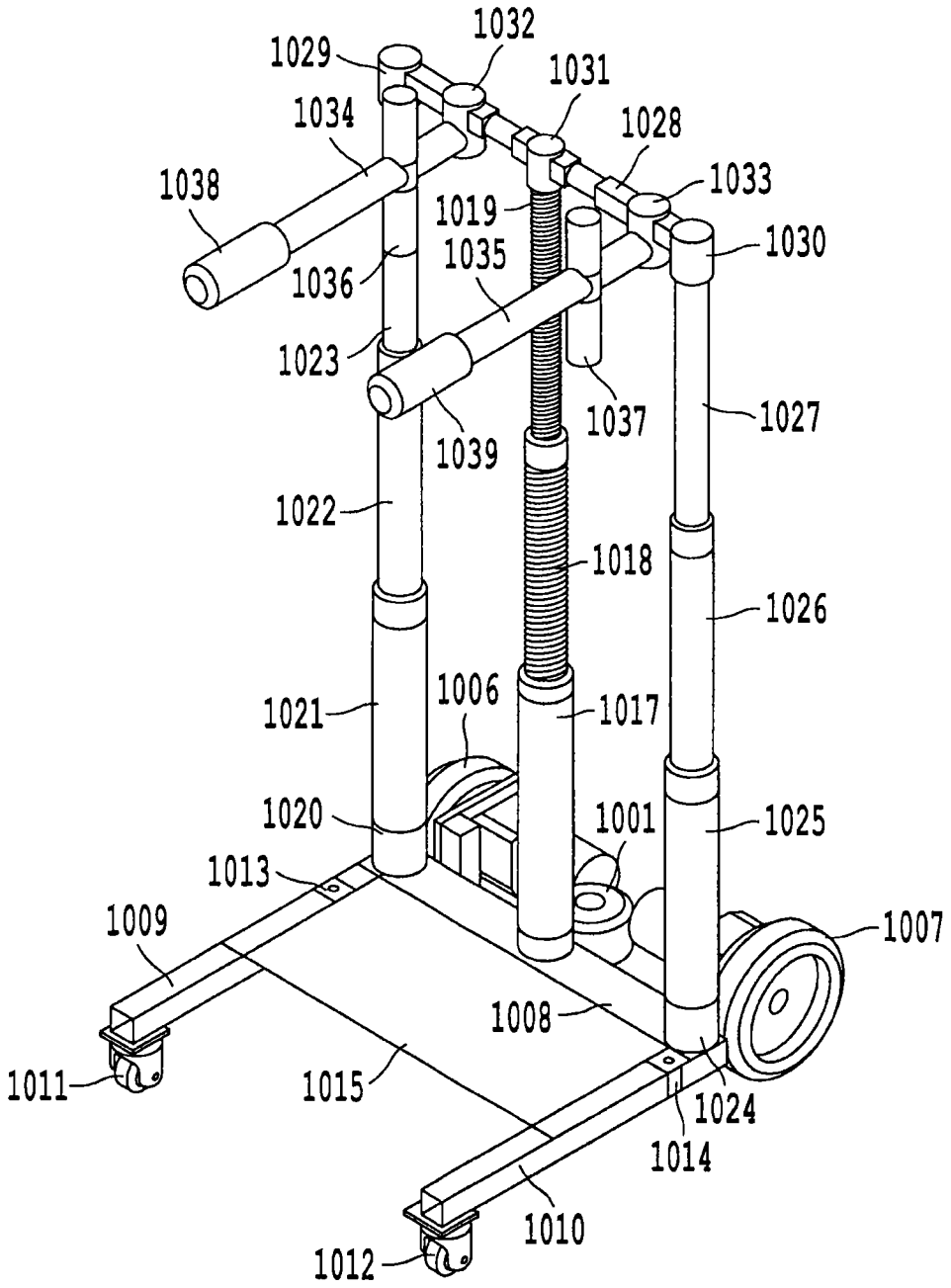
FIG. 2 is another perspective device view when the device is fully opened.
Figure 3:
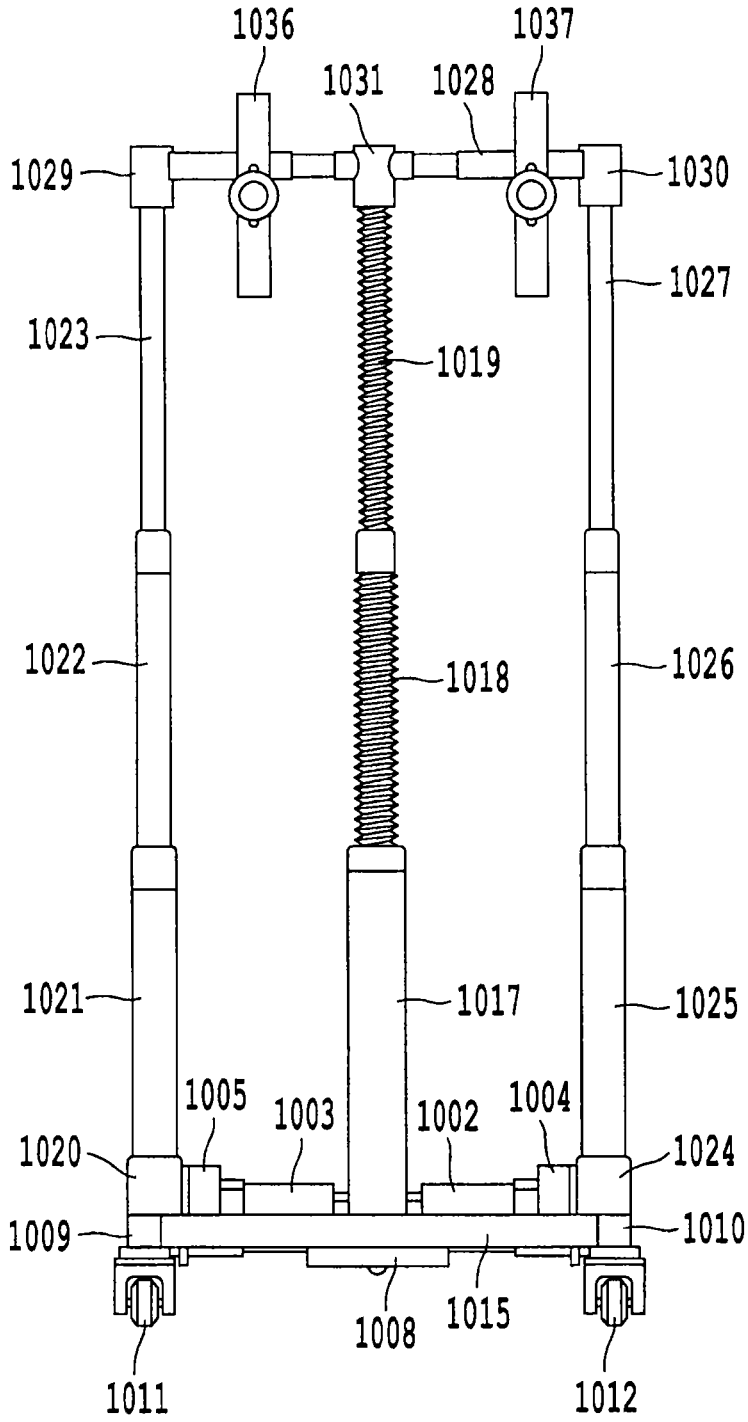
FIG. 3 is a front view of the device when the device is fully opened.
Figure 4:
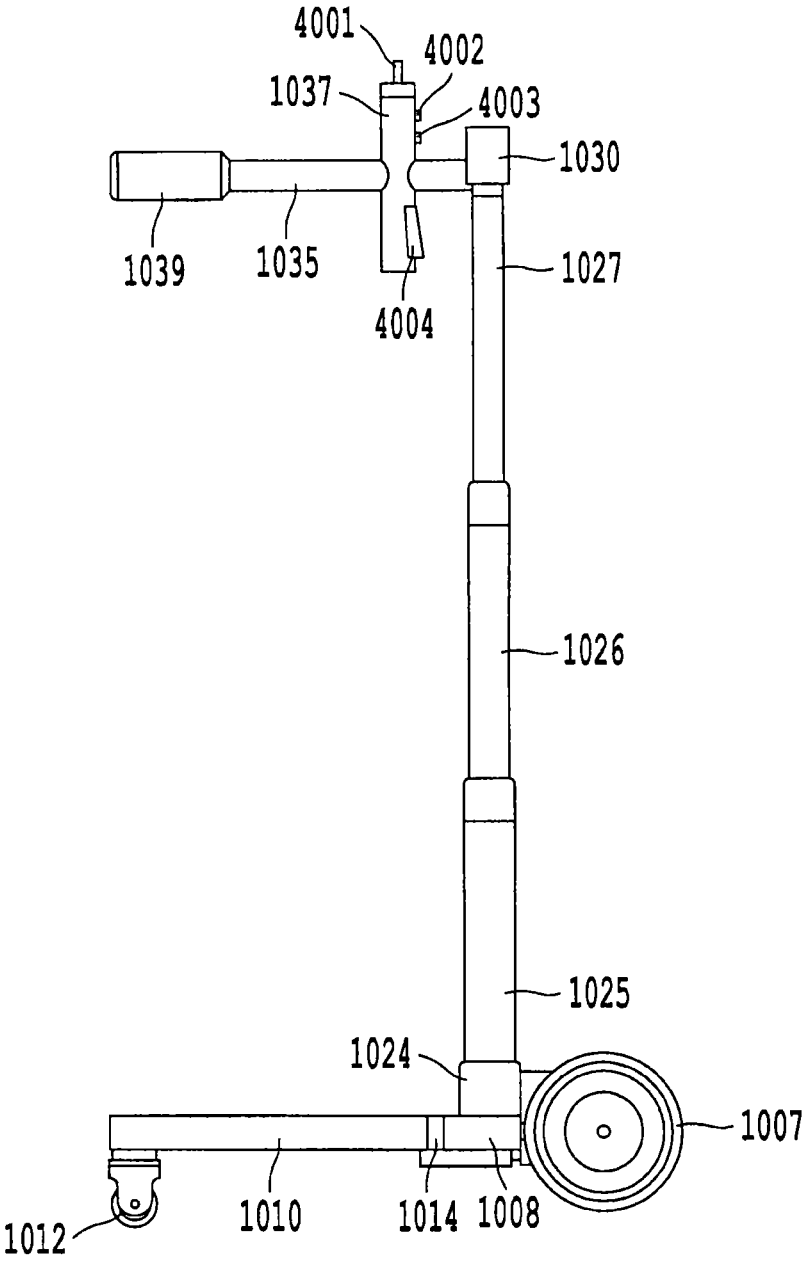
FIG. 4 is a side view of the device when the device is fully opened.

Referring now to the drawings, wherein like reference numerals designate identical or corresponding parts throughout the several views, FIGS. 1-4 are perspective views of an embodiment of the portable multifunctional mobility aid device when fully opened. The device is based on four wheels: a left front wheel (1006), a right front wheel (1007), a left rear free wheel (1011), and a right rear free wheel (1012). The left front wheel (1006) and the right front wheel (1007) are mounted to a base frame (1008). The left rear free wheel (1011) and the right rear free wheel (1012) are mounted on a left base frame beam (1009) and a right base frame beam (1010), respectively. The left base frame beam (1009) and the right base frame beam (1010) are connected to the base frame (1008) via a left hinge (1013) and a right hinge (1014), respectively.

Figure 5:
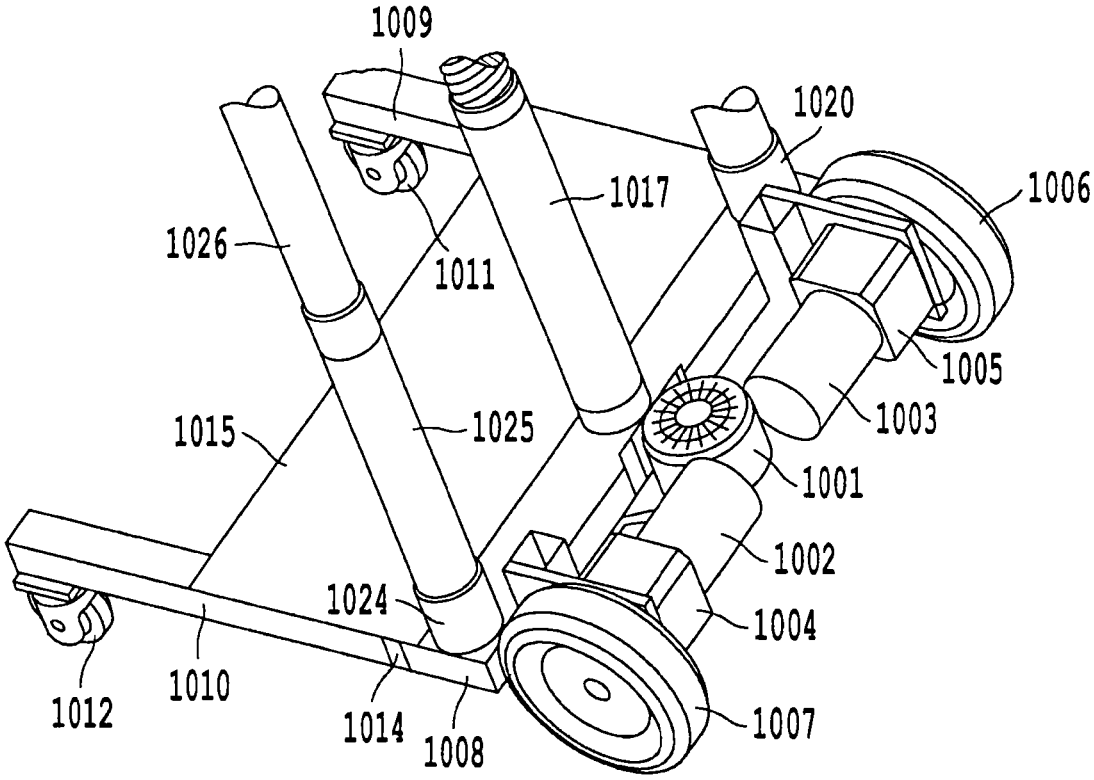
FIG. 5 is a partial perspective view of the device showing the device motors and holding plates.

FIG. 5 is a partial perspective device view showing the device motors and holding plates. The left front wheel (1006) and the right front wheel (1007) are driven by a left driving motor (1003) and a right driving motor (1002), respectively. The left driving motor (1003) and the right driving motor (1002) are connected to the base frame (1008) via a left front motor holder (1005) and a right front motor holder (1004), respectively.

Figure 10:
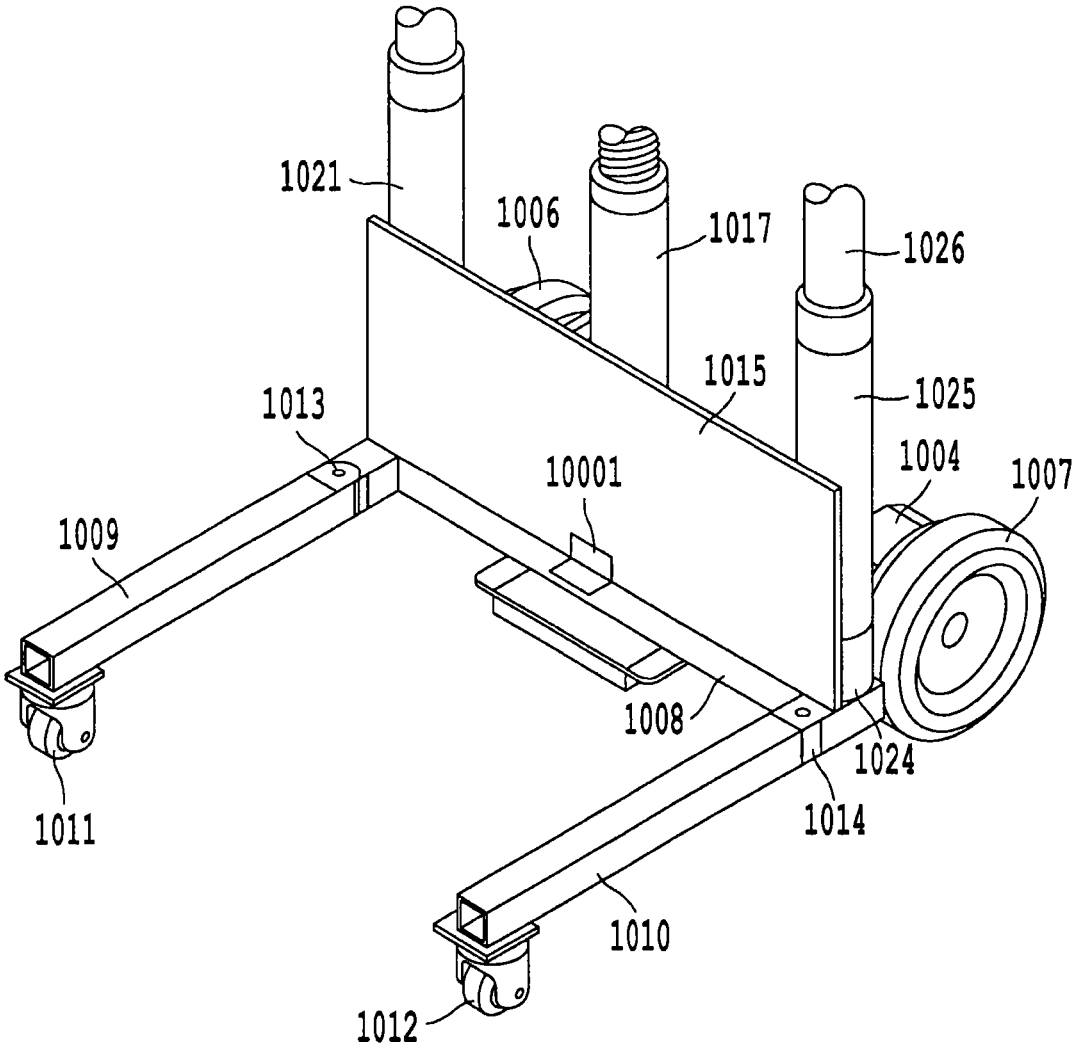
FIG. 10 is a perspective device view showing the standing plate in folded position.

A standing plate (1015) is supported by the left and right base frame beams (1009, 1010), and mounted to the base frame (1008) via a standing plate hinge (10001) which is shown in another perspective device view in FIG. 10.

A power screw motor (1001) is mounted to the base frame (1008). The power screw motor (1001) drives a lower power screw (1017) vertically mounted to the base frame (1008). A middle power screw (1018) is fully extending out of the lower power screw (1017). An upper power screw (1019) is fully extending out of the middle power screw (1018).

A left lower slider (1021) and a right lower slider (1025) are mounted on the base frame (1008) via a left lower slider holder (1020) and a right lower slider holder (1024), respectively. A left middle slider (1022) and a right middle slider (1026) are fully extending out of the left lower slider (1021) and the right lower slider (1025), respectively. A left upper slider (1023) and a right upper slider (1027) are fully extending out of the left middle slider (1022) and the right middle slider (1026), respectively.

The upper power screw (1019), the left upper slider (1023), and the right upper slider (1027), are connected to an upper beam (1028) via a power screw joint (1031), a left slider joint (1029), and a right slider joint (1030), respectively.

A left supporting beam (1034) and a right supporting beam (1035) are connected to the upper beam (1028) via a left supporting beam joint (1032) and a right supporting beam joint (1033), respectively. A left compressed sponge (1038) and a right compressed sponge (1039) are mounted to the end of the left supporting beam (1034) and the right supporting beam (1035) opposite to the left supporting beam joint (1032) and the right supporting beam joint (1033), respectively. A left handle (1036) and a right handle (1037) are vertically mounted to and protruding out of the left supporting beam (1034) and the right supporting beam (1035), respectively.

The left and right compressed sponges (1038, 1039) on the left and right supporting beams (1034, 1035) may have a curved or other ergonomic shape.

Next, the operation of the device is described with reference to the figures.

A user leans into the left and right supporting beams (1034, 1035) and adjusts the width between the left and right compressed sponges (1038, 1039) under his/her armpits. The user adjusts the left and right supporting beams (1034, 1035) via the left and right supporting beam joints (1032, 1033) to fit his width and make the left and right supporting beams (1034, 1035) catch his body to prevent him from falling back. The user grips the left and right handles (1036, 1037). The left and right handles (1036, 1037) may include up and down buttons (4002, 4003) to control the device height. The right handle may include a safety switch (4004) to make sure that the user is gripping the right handles (1037) while using the device. The safety switch (4004) is hinged to the right handle (1037) and held by a spring in an inactive state, and the device is disabled. When the right handle (1037) is gripped, the safety switch (4004) is pressed into an active state, thereby allowing the operation of the device. The left and right handles (1036, 1037) may also include a mobility button (4001) for controlling the operation of the left and driving motors (1003, 1002).

The user presses the up button (4002) or the down button (4003) depending on whether the user needs support for standing up or sitting down, respectively. The power screw motor (1001) starts rotating clockwise or counter-clockwise depending on whether the user needs assistance standing or sitting.

Figure 6:
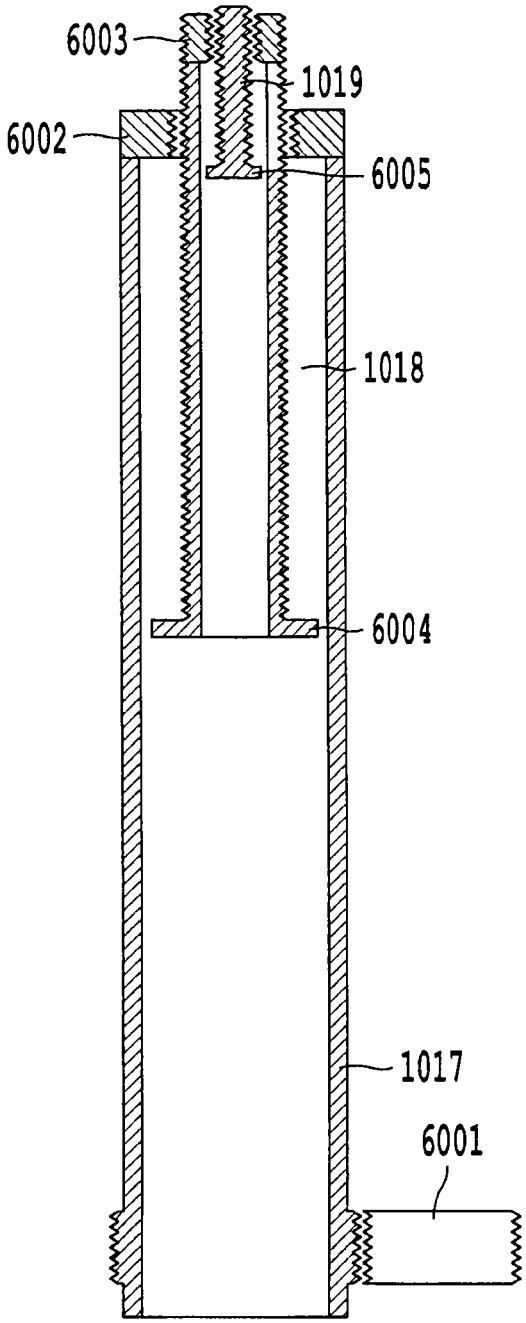
FIG. 6 is a cross section of the telescopic power screw.

FIG. 6 shows an embodiment of the power screw system. The rotation of the power screw motor (1001) is transmitted to the lower power screw by a gear stage (6001). Upon an activation of the power screw motor (1001), the lower power screw (1017) starts rotating, and since the upper power screw (1019) is fixed at the power screw joint (1031), the power screw system moves upward or downward, depending on the direction of the rotation of the motor. The lower, middle, and upper power screws (1017, 1018, 1019) have the same thread pitch, therefore their linear speed stays constant. There is a lower power screw nut (6002) and a middle power screw nut (6003) at the upper end of the lower power screw (1017) and the middle power screw (1018), respectively. Also, there is a middle power screw extended edge (6004) and an upper power screw extended edge (6005) at the bottom of the middle power screw (1018) and the upper power screw (1019), respectively. The middle and upper power screw extended edges (6004, 6005) prevent the lower, middle, and upper power screws (1017, 1018, 1019) from going out of each other.

The lower and middle power screw nuts (6002, 6003) may be made of a material different than the middle and upper power screws (1018, 1019), to reduce the manufacturing costs and the friction between the lower and middle power screw nuts (6002, 6003) and the middle and upper power screws (1018, 1019), respectively. The lower and middle power screw nuts (6002, 6003) may be made of copper.

According to another embodiment, the lower power screw (1017) may have a conical-shaped end on the side that is mounted on the base frame (1008) and a gear stage is attached to the conical-shaped end of the lower power screw (1017) after insertion in the base frame (1008).

The lower, middle, and upper power screws (1017, 1018, 1019) may be configured such that the middle power screw (1018) extends out of the lower power screw (1017) only when the upper power screw (1019) is fully extending out of the middle power screw (1018). In another embodiment, the lower, middle, and upper power screws (1017, 1018, 1019) may be configured such that the upper power screw (1019) extends out of the middle power screw (1018) only when the middle power screw (1018) is fully extending out of the lower power screw (1017).

The lifting system includes the power screw system, the right slider system, and the left slider system. The power screw system includes the lower, middle, and upper power screws (1017-1019). The left slider system includes the left lower, middle, and upper sliders (1021-1023). The right slider system includes the right lower, middle, and upper sliders (1025-1027). The power screw system carries the axial load of the user weight, while the right and left slider systems carry the bending moment due to the user weight. Each of the slider systems include three free pipes inside each other. To avoid lose fit between these three pipes, a bush is provided at the upper end of the lower and middle sliders. Also, to prevent the sliders from going out of each other, there are extended edges at the bottom of the left middle and upper sliders (1022, 1023) and at the bottom of the right middle and upper sliders (1026, 1027).

The user can stand on the standing plate (1015) and drive the device. Toggle switches on the left and right handles (1036, 1037) or a joystick may be used to control the device. Before the user starts driving the device, he should slide the left and right supporting beams (1034, 1035) along the upper beam (1028) until they catch him very well on the sides of his body, to prevent him from falling due to a backward force or any sudden movement.

Figure 7:
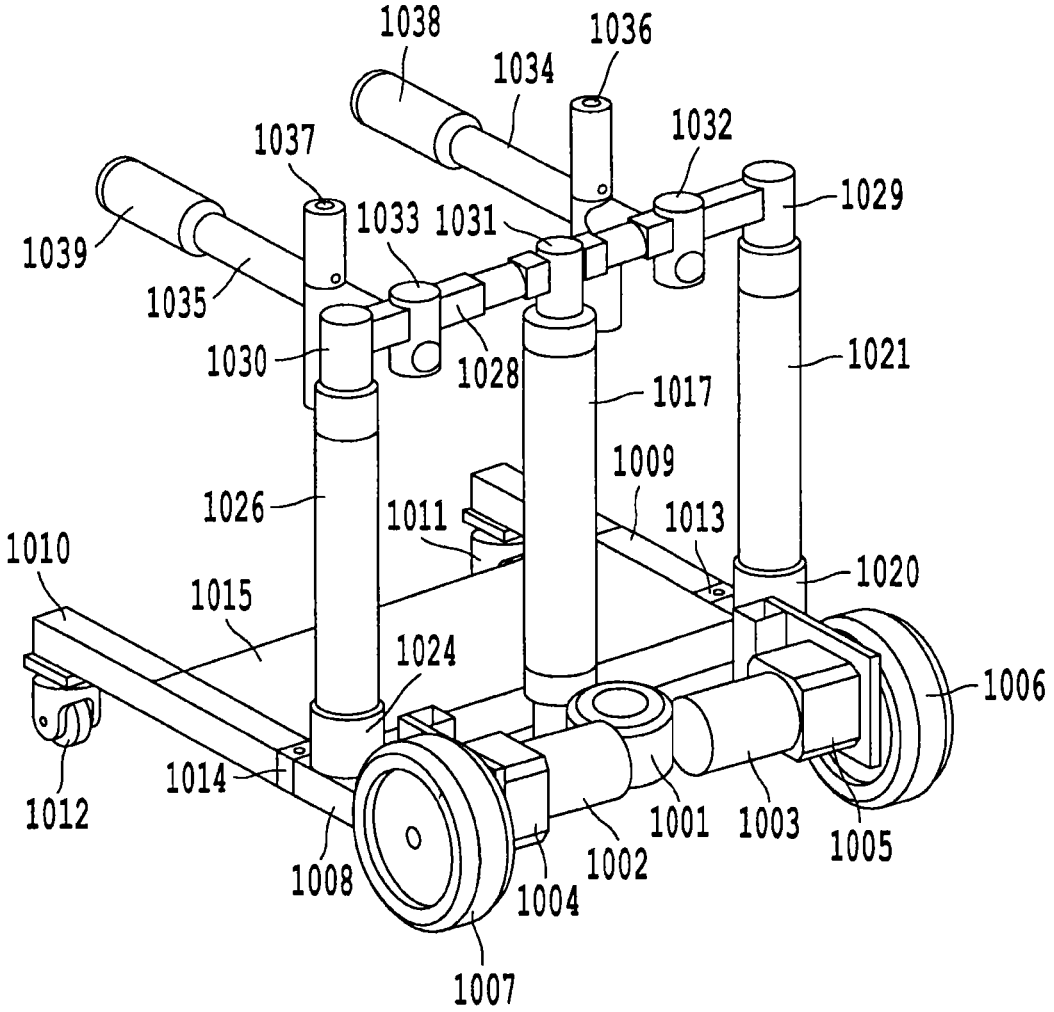
FIG. 7 is a perspective device view when the device has its minimum height.
Figure 8A:
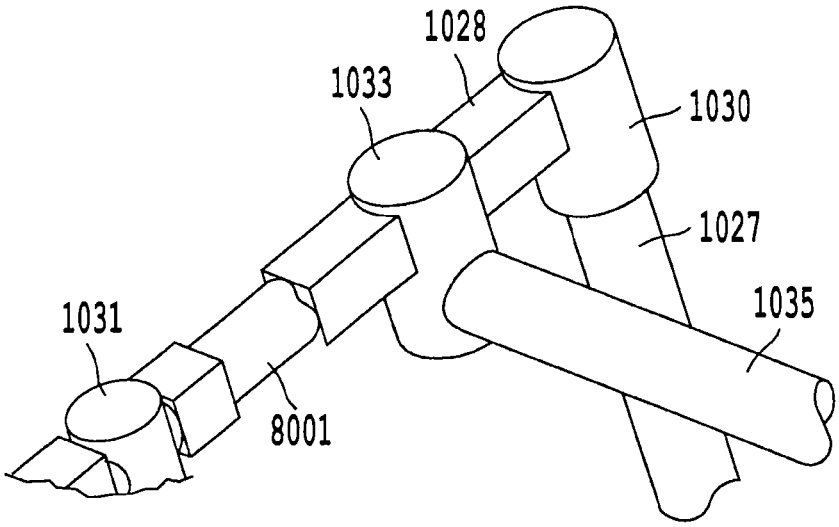
FIGS. 8A and 8B are perspective device views showing a supporting beam in opened and folded position, respectively.
Figure 8B:
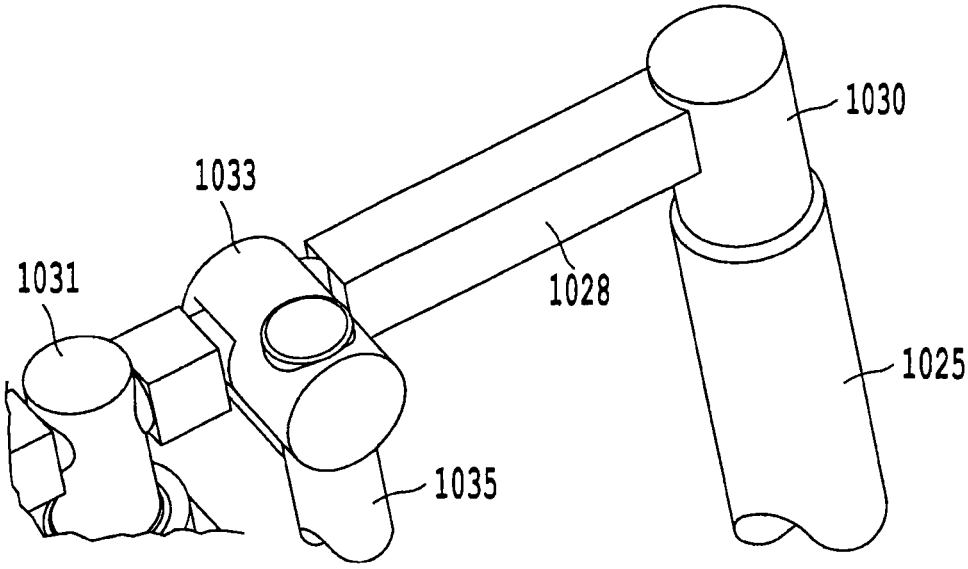
Figure 9:
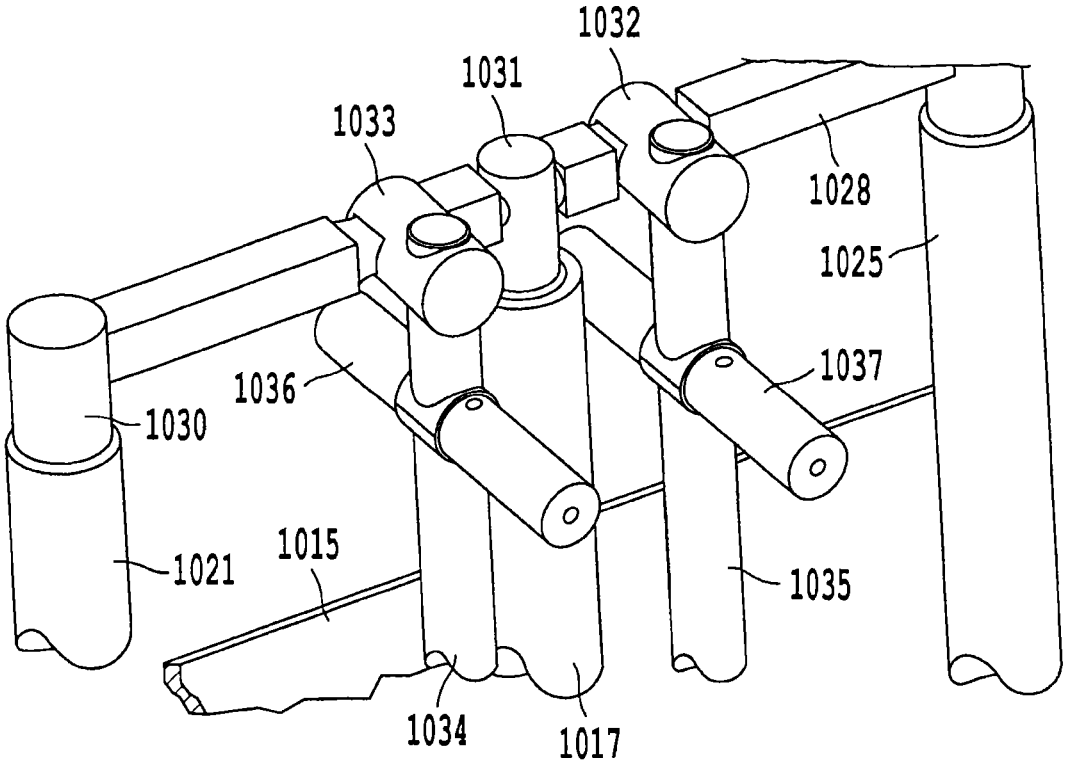
FIG. 9 is a perspective device view showing both supporting beams in folded position.

To store or transfer the device in a small area such as a car trunk, the user can fold the device to a minimum device size. To minimize the device, the user may reduce the device height to a minimum height, as shown in FIG. 7. Then, the user folds the left and right supporting beams (1034. 1035). FIGS. 8A and 8B are perspective device views showing the right supporting beam in opened and folded positions, respectively. The upper beam (1028) has a square-shaped cross section except in an area on each side of its center which is a cylindrical section (8001). To fold the right supporting beam (1035), the user should slide the right supporting beam (1035) toward the cylindrical section (8001) of the upper beam (1028), and then fold the right supporting beam (1035) down. The left supporting beam (1034) is similarly folded. FIG. 9 is a perspective device view showing the left and right supporting beams (1034, 1035) in folded position.

Figure 11:
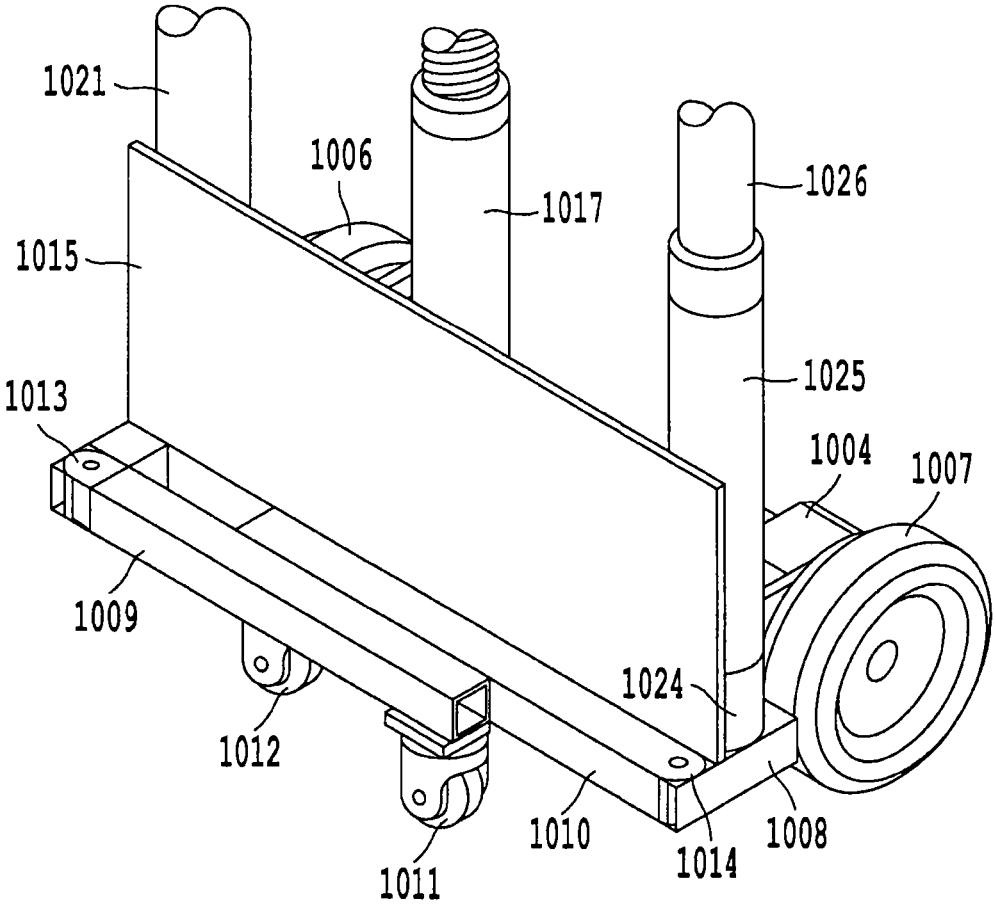
FIG. 11 is a perspective device view showing the standing plate and the left and right base frame beams in folded position.
Figure 12:
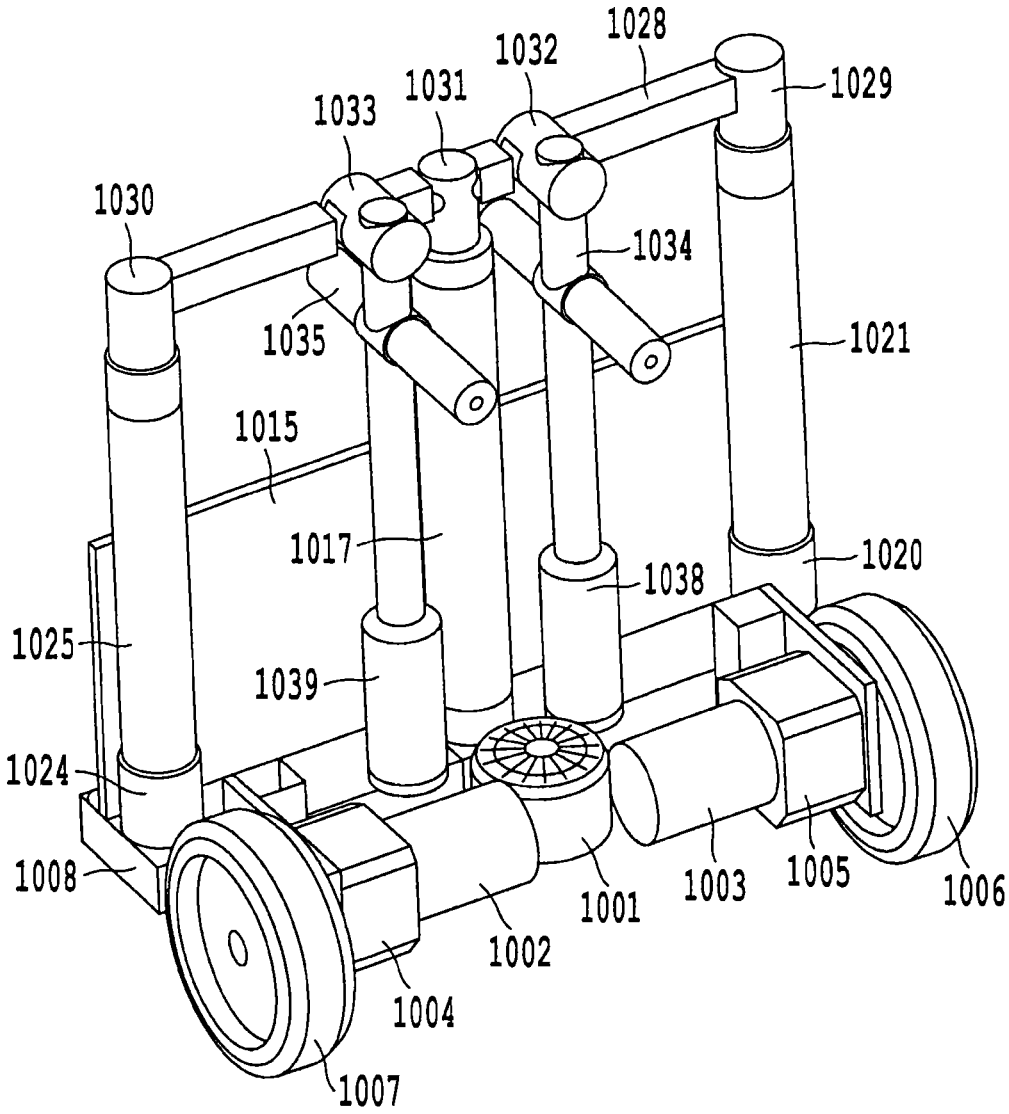
FIG. 12 is a perspective device view showing the device in its minimal size.
Figure 13:
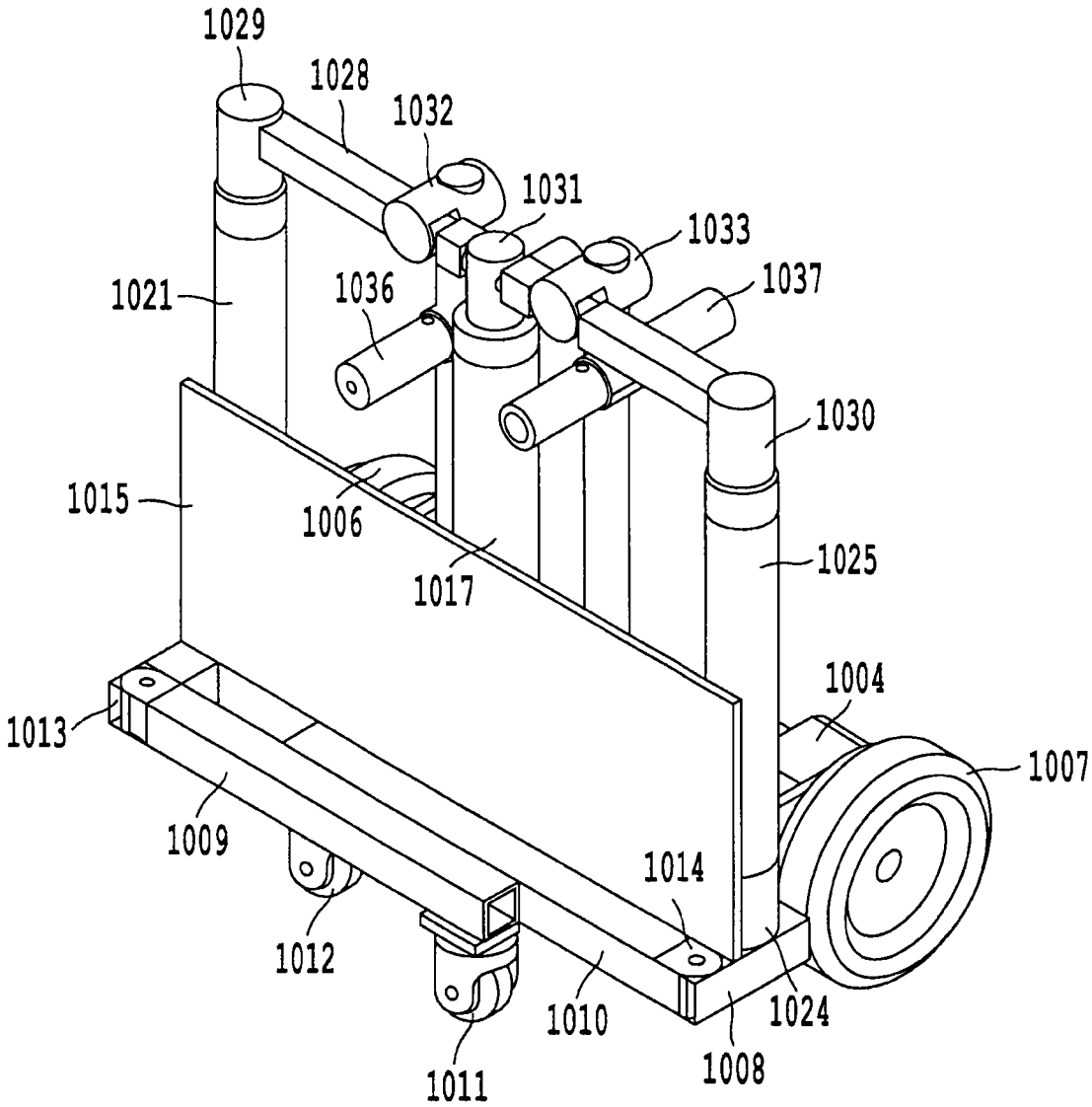
FIG. 13 is another perspective device view showing the device in its minimal size.

After folding the left and right supporting beams (1034, 1035), the user folds the standing plate (1015), and then the left and right base frame beams (1009, 1010). FIG. 10 is a perspective device view showing the standing plate (1015) in folded position. FIG. 11 is a perspective device view showing the standing plate (1015) and the left and right base frame beams (1009, 1010) in folded position. FIGS. 12 and 13 are perspective device views showing the device in its minimal size.

The device may be used as a passive walker with wheels by folding the standing plate (1015) and disabling the left and right driving motors (1003, 1002).

The left and right driving motors (1003, 1002) and the power screw motor (1001) are operated by batteries which may be rechargeable Lithium-Ion batteries. The batteries are preferably located at or around the device center of gravity to enhance device stability. The remaining charge of the batteries may be reported to the user by an indicator provided on a control panel.

The power screw, motor (1001) may lock itself if the battery is low, to prevent the power screw system from collapsing.

Figure 14A:
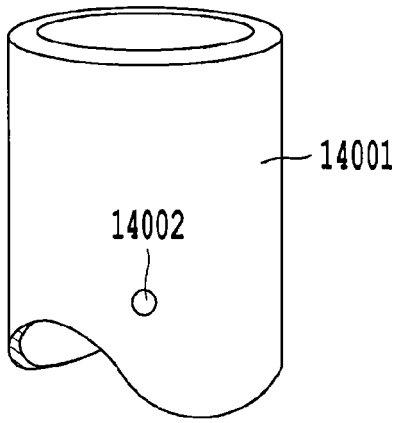
FIGS. 14A-14C are perspective views of a trailer hitch connection system and accessories.
Figure 14B:
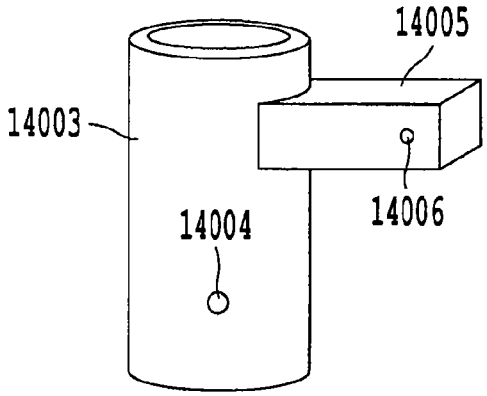
Figure 14C:
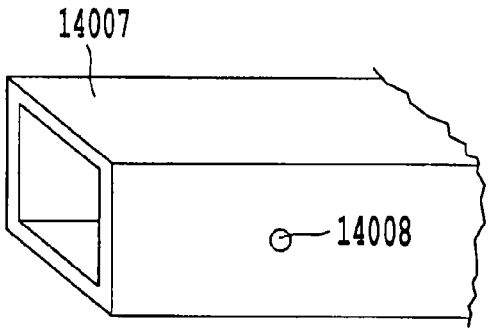

The device may include a mechanical coupling feature on the front side of its top portion such that the device may be used with a trailer connector to lift and move the device. FIGS. 14A, 14B, and 14C are perspective views of different parts of a trailer hitch connection and accessories. In this embodiment, the top portion of the power screw joint (1031) is a hollow cylinder (14001) with a pin cavity (14002). The hollow cylinder (14001) is adapted to receive a hitch accessory (14003). A hitch connector (14005) is mounted to the top portion of the hitch accessory (14003) and is adapted to be received by a trailer hitch (14007). The hitch accessory (14003) has a first hitch accessory pin cavity (14004) and a second hitch accessory pin cavity (14006). The trailer hitch (14007) also has a trailer hitch pin cavity (14006). The hollow cylinder pin cavity (14002) and the first hitch accessory pin cavity (14004) are aligned when the hitch accessory (14003) is properly placed into the hollow cylinder (14001), so a pin could be used to secure them together. The second hitch accessory pin cavity (14006) and the trailer hitch pin cavity (14008) are also aligned when the hitch connector (14005) is properly inserted into the trailer hitch (14007), so a pin could be used to secure them together.

To lift the device by the above-described hitch connection system, the height of the device is brought to the same height as the trailer hitch (14007), and the device is attached to the trailer hitch (14007). The height of the device is then minimized, causing the device to be lifted.

Figure 15:
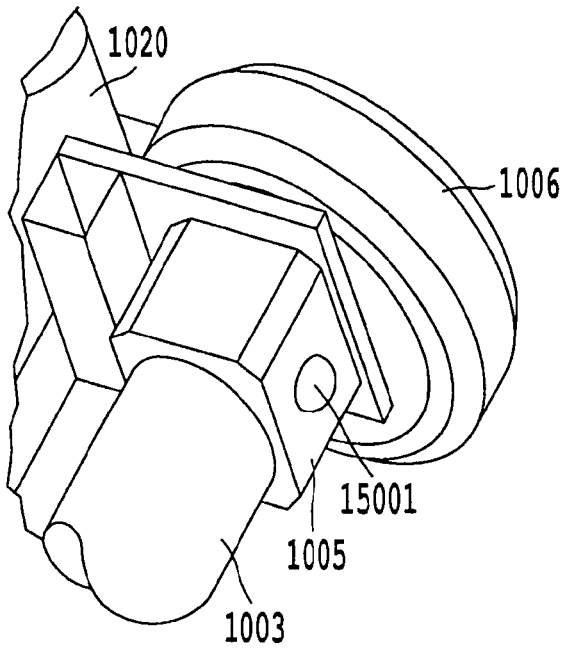
FIG. 15 is a perspective view of the device showing an optical detector.

The device may include optical sensors mounted on the front side of the device to sense the shape of the path in front of the device and send feedback to stop the device when the path shape in front of the device is an uneven path shape such as stairs. FIG. 15 is a perspective view of the device showing an optical detector (15001) mounted on the left front motor holder (1005).

Figure 16:
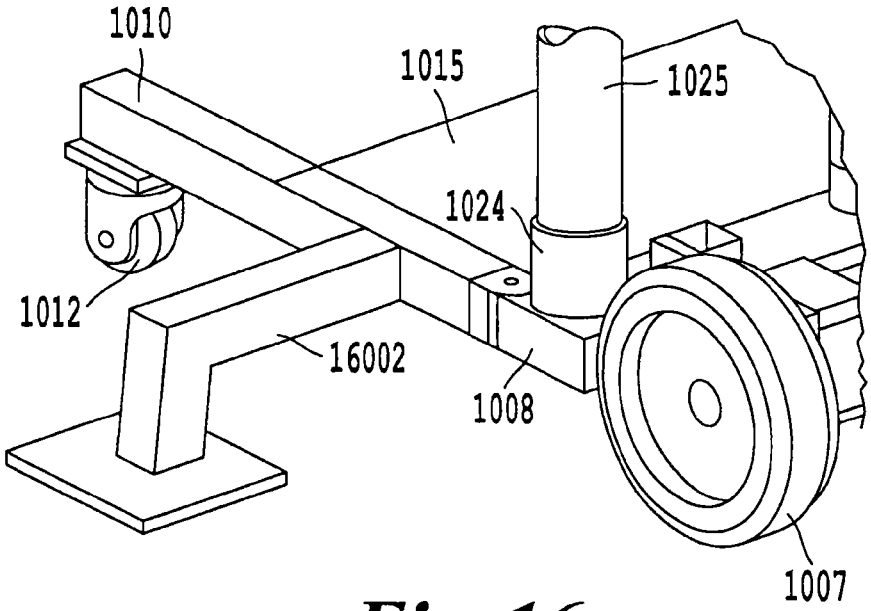
FIG. 16 is a perspective view of the device showing an outrigger.

The device may have a pair of outriggers or stabilization bars for added stability. FIG. 16 is a perspective view of the device showing a right outrigger (16002). A corresponding left outrigger is not shown in this figure, however, the descriptions provided for the right outrigger (16002) also apply to the left outrigger. The right outrigger (16002) is attached to the outer side of the right base frame beam (1010). The right outrigger (16002) may be initially in a folded position via a hinge. The right outrigger (16002) may then be rotated away from the right base frame beam (1010) and positioned on the floor while the user is using the device for standing up or sitting down. The right outrigger (16002) may be motorized and controllable via a control panel.

Figure 17:
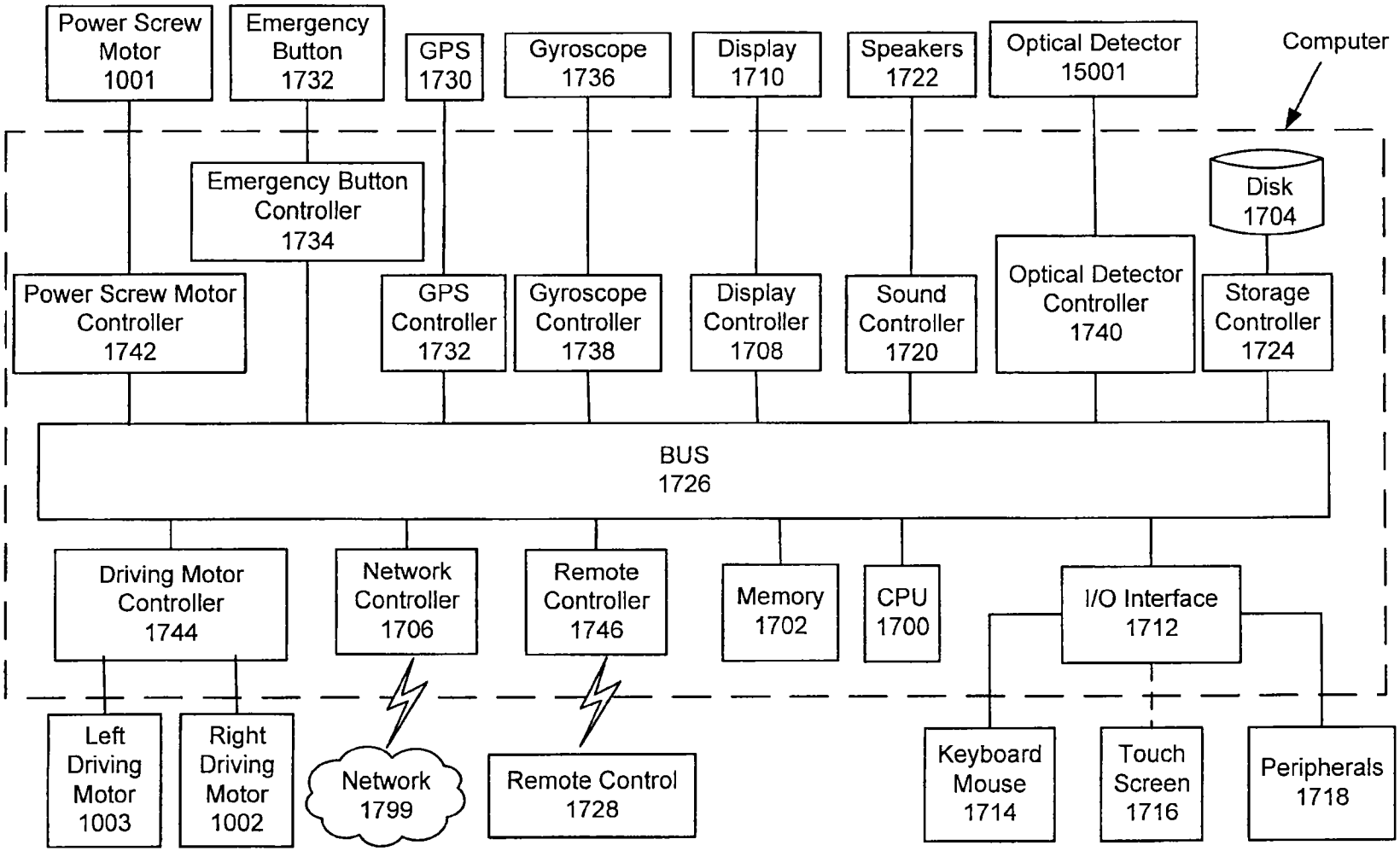
FIG. 17 is a block diagram of a computer used for operating the device.

Next, a hardware description of a computer according to exemplary embodiments is described with reference to FIG. 17. The computer may be used to operate the device. In FIG. 17, the computer includes a CPU (1700) which performs the processes necessary to operate the device. The process data and instructions may be stored in memory (1702). These processes and instructions may also be stored on a storage medium disk (1704) such as a hard drive (HDD) or portable storage medium, or may be stored remotely. Further, the claimed advancements are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the computer communicates, such as a server.

Further, the claimed advancements may be provided as a utility application, background daemon, or component of an operating system, or combination thereof, executing in conjunction with CPU (1700) and an operating system such as Microsoft Windows 7, UNIX, Solaris, LINUX, Apple MAC-OS and other systems known to those skilled in the art.

CPU (1700) may be a Xenon or Core processor from Intel of America or an Opteron processor from AMD of America, or may be other processor types that would be recognized by one of ordinary skill in the art. Alternatively, the CPU (1700) may be implemented on an FPGA, ASIC, PLD or using discrete logic circuits, as one of ordinary skill in the art would recognize. Further, CPU (1700) may be implemented as multiple processors cooperatively working in parallel to perform the instructions of the inventive processes described above.

The computer in FIG. 17 also includes a network controller (1706), such as an Intel Ethernet PRO network interface card from Intel Corporation of America, for interfacing with network (1799). As can be appreciated, the network (1799) can be a public network, such as the Internet, or a private network such as an LAN or WAN network, or any combination thereof, and can also include PSTN or ISDN sub-networks. The network (1799) can also be wired, such as an Ethernet network, or can be wireless such as a cellular network including EDGE, 3G and 4G wireless cellular systems. The wireless network can also be WiFi, Bluetooth, or any other wireless form of communication that is known.

The wireless network may be used to identify and/or monitor the location of the device by another person such as a primary care giver.

A remote controller (1746) may be used in conjunction with a remote control (1728) to remotely operate the device and, for example, drive the device to the location of the user.

The computer further includes a display controller (1708), such as a NVIDIA GeForce GTX or Quadro graphics adaptor from NVIDIA Corporation of America for interfacing with display (1710), such as a Hewlett Packard HPL2445w LCD monitor. A general purpose I/O interface (1712) interfaces with a keyboard and/or mouse (1714) as well as a touch screen panel (1716) on or separate from display (1710). General purpose I/O interface also connects to a variety of peripherals (1718) including printers and scanners, such as an OfficeJet or DeskJet from Hewlett Packard.

A sound controller (1720) is also provided in the computer, such as Sound Blaster X-Fi Titanium from Creative, to interface with speakers/microphone (1722) thereby providing sounds and/or music. The speakers/microphone (1722) can also be used to accept dictated words as commands for controlling the computer or for providing location and/or property information with respect to the target property.

The general purpose storage controller (1724) connects the storage medium disk (1704) with communication bus (1726), which may be an ISA, EISA, VESA, PCI, or similar, for interconnecting the components of the computer. A description of the general features and functionality of the display (1710), keyboard and/or mouse (1714), as well as the display controller (1708), storage controller (1724), network controller (1706), sound controller (1720), and general purpose I/O interface (1712) is omitted herein for brevity as these features are known.

The computer may include a GPS (1730) connected to a GPS controller (1732) to provide a navigation system. The navigation system may provide routes with no steps or irregular path shapes. The navigation system may be via a Bluetooth connection to Google maps on the user's cell phone via the network controller (1706). The navigation display may be included in the display (1710).

The computer may have an emergency button (1732) connected to an emergency button controller (1734). The emergency button (1732) is controlled by the user to ask for help in case of emergency. The emergency button (1732) may be connectable to the user's body by a clip-on strap such that if the user falls off of the device, the emergency button (1732) is activated.

The computer may include a gyroscope (1736) connected to a gyroscope controller (1738) to indicate the orientation of the device. The gyroscope (1736) may activate an audible alarm via the speakers (1722), a wireless alarm via the network controller (1706), or another emergency indicator, when the orientation of the device indicates tipping over.

The optical detector (15001) is connected to an optical detector controller (1740) within the computer.

The power screw motor (1001) is connected to a power screw motor controller (1742) within the computer. The left and right driving motors (1003, 1002) are connected to a driving motor controller (1744) within the computer.

Figure 18:
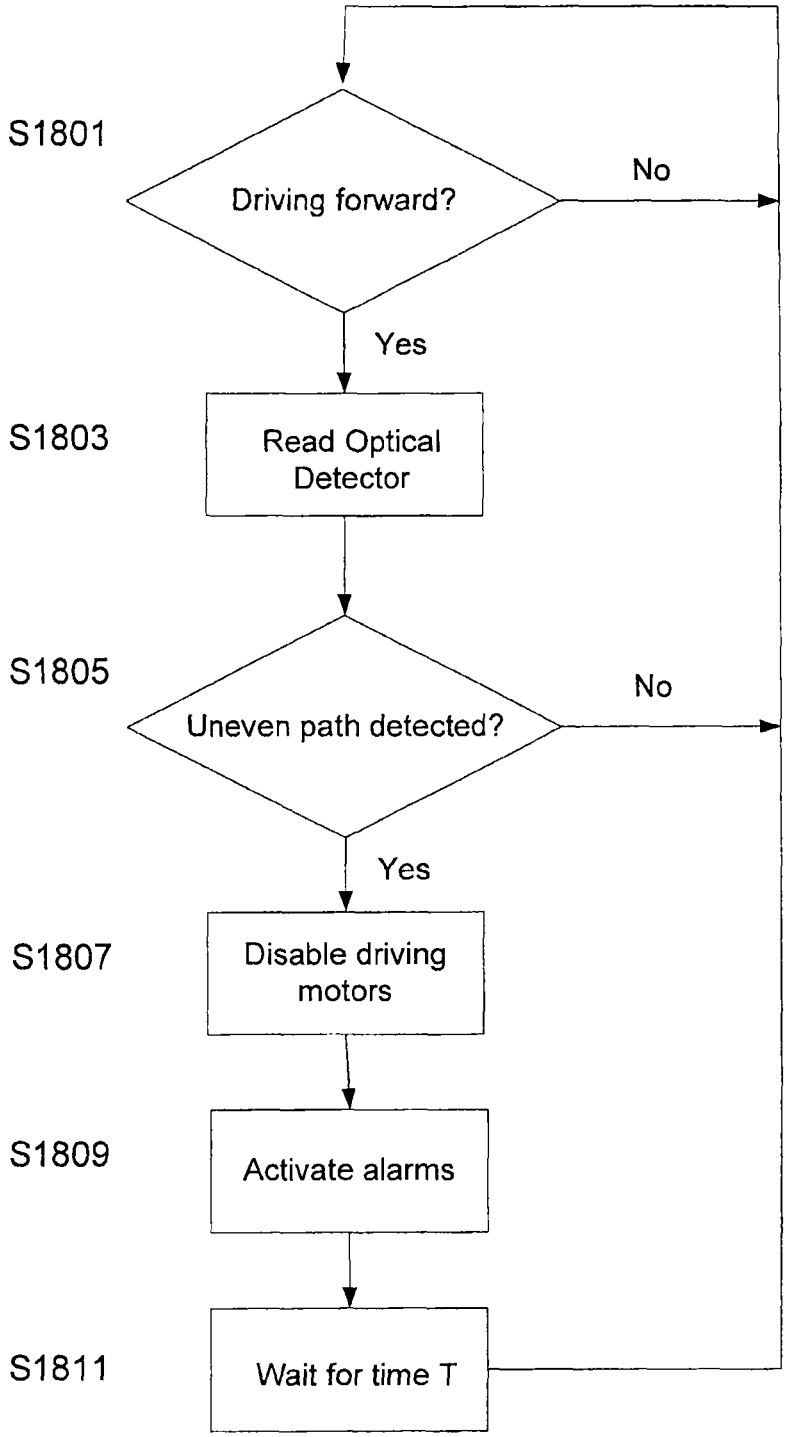
FIG. 18 shows a flowchart to control the device based on the read-out from the optical detector.

FIG. 18 shows a flowchart for controlling the device based on the read-outs from the optical detector (15001). The process starts in step (S1801) where the device checks if the device is driving forward. If the answer is no, the process stays in step (S1801). Otherwise, in step (S1803) the process reads the optical detectors (15001). Then, in step (S1805) the read-out from the optical detector (15001) is analyzed to determine if there is an uneven path ahead of the device. If the answer is no, the process loops back to step (S1801). Otherwise, in step (S1807) the left and right driving motors (1003, 1002) are disabled to prevent the device from proceeding toward the uneven path. Then, in step (S1809) an alarm indicating the uneven path is activated. Then, in step (S1811) the process waits for a predetermined time T, and loops back to step (S1801).

Figure 19:
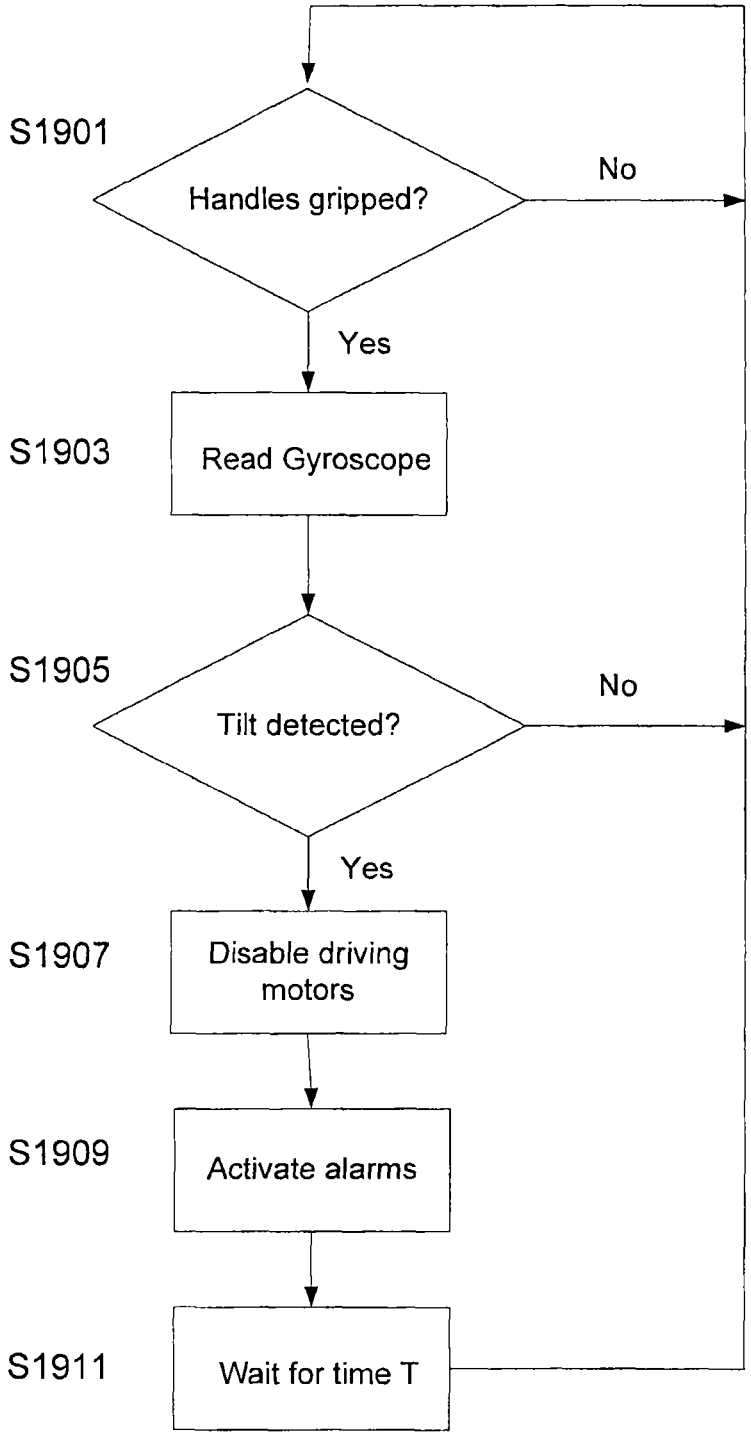
FIG. 19 shows a flowchart to control the device based on the read-out from the gyroscope.

FIG. 19 shows a flowchart for controlling the device based on the read-outs from the gyroscope (1736). The process starts in step (S1901) where the device checks if the handles are gripped. If the answer is no, the process stays in step (S1901). Otherwise, in step (S1903) the process reads the gyroscope (1736). Then, in step (S1905) the read-out from the gyroscope (15001) is analyzed to determine if the device is tilted. If the answer is no, the process loops back to step (S1901). Otherwise, in step (S1907) the left and right driving motors (1003, 1002) are disabled. Then, in step (S1909) an alarm indicating the tilting of the device is activated. Then, in step (S1911) the process waits for a predetermined time T, and loops back to step (S1901).

FIG. 20 is a table showing the operation of the left and right front wheels (1006, 1007) in response to the user commands to the left and right front motors (1003, 1002). The device can be operated to move forward or backward, or make a right or a left turn, by controlling the direction of the rotation of the left and right front wheels (1006, 1007). For example, to drive the device forward, the right front wheel (1007) rotates clockwise, while the left front wheel (1006) rotates counter-clockwise. As another example, to make the device turn right, the left and right front wheels (1006, 1007) both rotate counter-clockwise. This will cause the device to have a very small turning radius.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, define, in part, the scope of the foregoing claim terminology such that no inventive subject matter is dedicated to the public.

The invention claimed is:

1. A method of reducing a volume occupied by a multi-functional mobility aid device comprising:

lowering a height of a lifting mechanism mounted to a base frame, by a bi-directional vertical motion of the lifting mechanism, via a control panel mounted to a pair of handles attached to a pair of supporting beams, the pair of supporting beams being mounted to a horizontal beam, the horizontal beam being mounted to a first side of the lifting mechanism, a second side of the lifting mechanism opposite to the first side being mounted to the base frame;

folding the pair of supporting beams to align the pair of supporting beams with the lifting mechanism;

folding a standing plate mounted to the base frame away from the base frame and toward the lifting mechanism via a hinge connecting the standing plate to the base frame;

securing the standing plate against the lifting mechanism via a magnet disposed on the lifting mechanism;

folding the base frame by folding a pair of base frame beams hinged to a central portion of the base frame toward the central portion of the base frame; and securing the base frame in a folded position by a locking mechanism.

2. The method of claim 1, further comprising:

folding the pair of supporting beams having hollow cavities with square-shaped cross sections by sliding the pair of supporting beams from a pair of first segments of the horizontal beam to a pair of second segments of the horizontal beam, the pair of first segments of the horizontal beam having square-shaped cross sections adapted to be received by the hollow cavity, the pair of second segments of the horizontal beam having cylindrical cross sections.

* * * * *